US005773750A

United States Patent [19]

Jae et al.

[11] Patent Number: 5,773,750

[45] Date of Patent: Jun. 30, 1998

[54] ROCK FRAGMENTATION SYSTEM USING GOLD SCHMIDT METHOD

[75] Inventors: Hwan-Young Jae, Seoul; Chwll-Hwa Park, Namdong-gu; Hak-Won Kim, Kyunggi-do; Byung-Ro Song, Seoul; Woo-Sik Kim, Seoul; Dae-Seung Kim, Seoul, all of Rep. of Korea

[73] Assignee: Soosan Special Purpose Vehicle Co., Ltd., Chungnam, Rep. of Korea

[21] Appl. No.: 735,112

[22] Filed: Oct. 22, 1996

[30] Foreign Application Priority Data

Oct. 30, 1995 [KR] Rep. of Korea ..... 1995-38020

[51] Int. Cl.[6] ..... F42B 3/00

[52] U.S. Cl. ..... 102/302; 102/315; 102/705; 86/21

[58] Field of Search ..... 102/302, 305, 102/705; 86/21

[56] References Cited

U.S. PATENT DOCUMENTS

| | | | |
|---|---|---|---|
| 4,216,721 | 8/1980 | Marziano et al. | 102/90 |
| 4,681,643 | 7/1987 | Colgate et al. | 149/21 |
| 4,869,170 | 9/1989 | Dahmberg et al. | 102/202.5 |
| 5,035,756 | 7/1991 | Covino | 149/37 |
| 5,212,343 | 5/1993 | Brupbacher et al. | 102/323 |
| 5,495,812 | 3/1996 | Schulze | 110/237 |

OTHER PUBLICATIONS

Lee, W.M., *Metal/Water Chemical Reaction Coupled to a Pulsed Electrical Discharge*, J. App. Phys. 69 (10) 15 May 1991.

Theofanous, T.G. et al, *Ignition of Al Droplets Behind Shock Waves in Water*, Phys. Fluids 6 (11), Nov. 1994.

*Primary Examiner*—Peter A. Nelson

*Attorney, Agent, or Firm*—Oblon, Spivak, McClelland, Maier & Neustadt, P.C.

[57] ABSTRACT

A rock fragmentation system using Gold Schmidt method and process for blasting using the machine are provided, wherein the blasting machine has a capacitor bank, a switch, a high voltage electric power supply, a first charge dump and a second charge dump, and an electrode assembly which is connected to capacitor bank and switch with a coxial cable and electrodes at a lower end of the electrode assembly, wherein an aluminum and metal oxide composition of a predetermined mixture ratio is inserted between electrodes in a lower end of the electrode assembly for generating an instant reaction energy by discharging the electric energy.

5 Claims, 3 Drawing Sheets

ROCK FRAGMENTATION SYSTEM USING GOLD SCHMIDT METHOD

BACKGROUND OF THE INVENTION

1. Field of the Invention

The present invention relates to a rock fragmentation system using Gold Schmidt method that instantly discharges stored electric energy from a condenser into a composition comprising a mixture of aluminium and a metal oxide in a weight ratio sufficient to cause an explosion upon sudden electrical charging of the aluminum/metal oxide composition, wherein the mixture is inserted between electrodes in a lower end of an electrode assembly so that instant reaction energy is generated to cause an explosion.

2. Discussion of the Background

Generally, in blasting for construction work, public works, or excavating works, explosives (such as dynamite), machinery (such as hydraulic jacks and breaker), or chemicals (expandable demolition material) have been used.

However, when explosives, such as dynamite, are used for blasting, the blasting is very difficult to perform in crowded or urban areas (i.e. downtown) and is restricted in time and working area, since vibration and noises is very high. Broken pieces are scattered and a large quantity of dust is generated.

Accordingly, when blasting is performed using explosives such as dynamite, antipollution facilities and safty appliances must be installed, thereby increasing cost. Still, in spite of these safty precautions, it is very dangerous.

Recently, a plasma blasting method using electric energy has been disclosed. This method involves instantly discharging very large electric energy into electrodes in a rock thereby producing an explosion.

However, this method is limited in blasting force by the supply of electric energy, and is not efficient to use in construction work, public works and excavating works due to the large size of the machine required.

SUMMARY OF THE INVENTION

Accordingly, one object of the present invention is to provide a blasting method that solves the above described problems of the prior art.

A further object of the present invention is to provide a rock fragmentation system using Gold Schmidt reduction method which reduces vibration and noise, eliminates scattering of broken pieces and dust and provides sufficient blasting force, thereby improving the safety and usefulness of the blasting process.

These and other objects of the present invention have been satisfied by the discovery of a rock fragmentation system using Gold Schmidt method comprising a high voltage power supply a capacity bank, a switch, a first charge dump and a second charge dump, and an electrode assembly which is connected to and operated with the capacitor bank and switch and has electrodes at a lower end of the electrode assembly, wherein a composition comprising a mixture of aluminum (Al) and a metallic oxide (MO) in a weight ratio of Al:MO sufficient to cause an explosion upon rapid application of high voltage electrical energy, is inserted between the electrodes in the lower end of the electrode assembly for generating instant reaction energy by discharging the electric energy to cause an explosion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
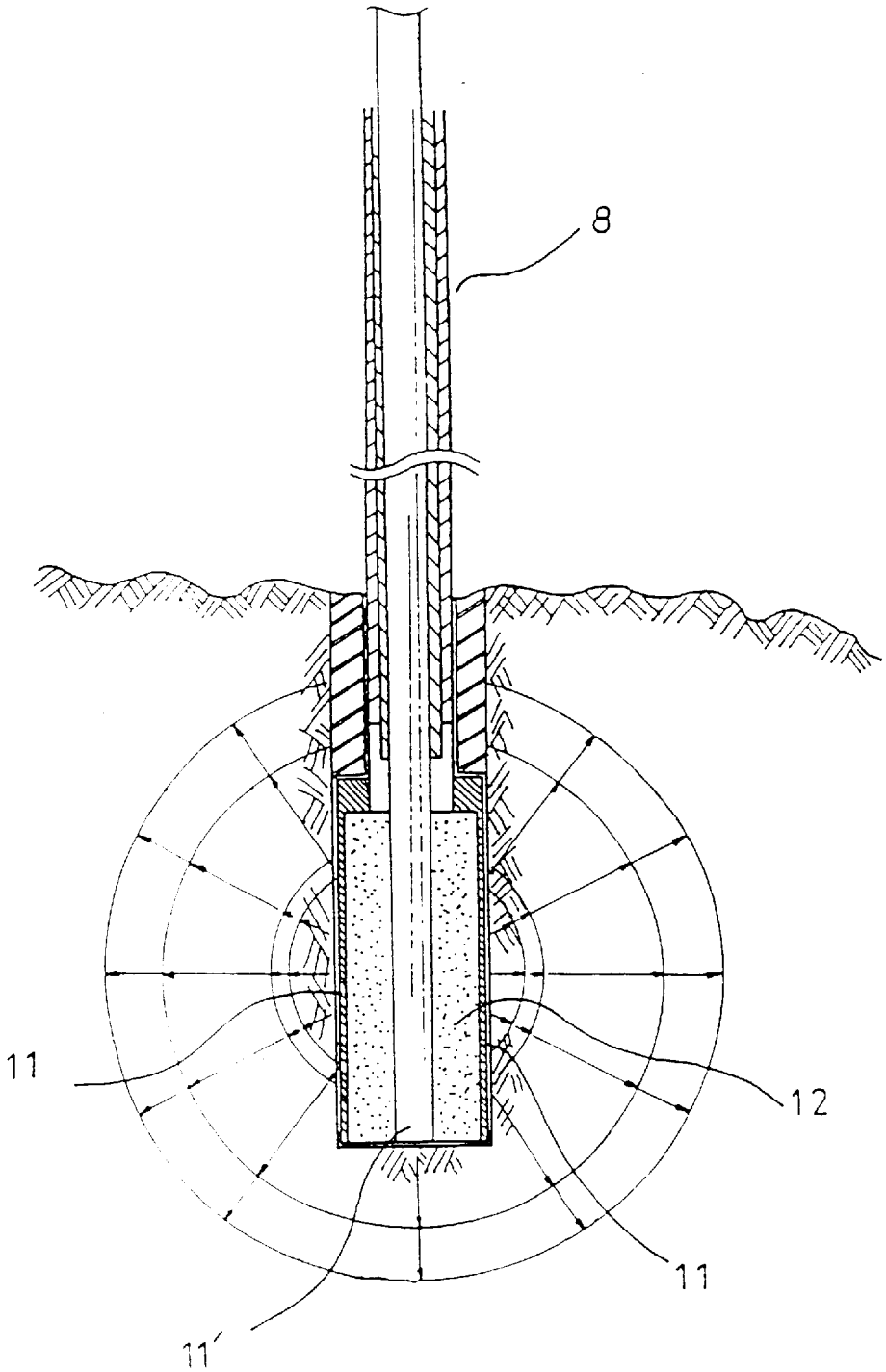
FIG. 3 is an enlarged section view illustrating a lower end of an electrode assembly in accordance with an embodiment of the present invention.

A rock fragmentation system using Gold Schmidt method is accordance with a preferred embodiment of the present invention will now be described in detail with reference to FIGS. 1 and 3.

Figure 1:
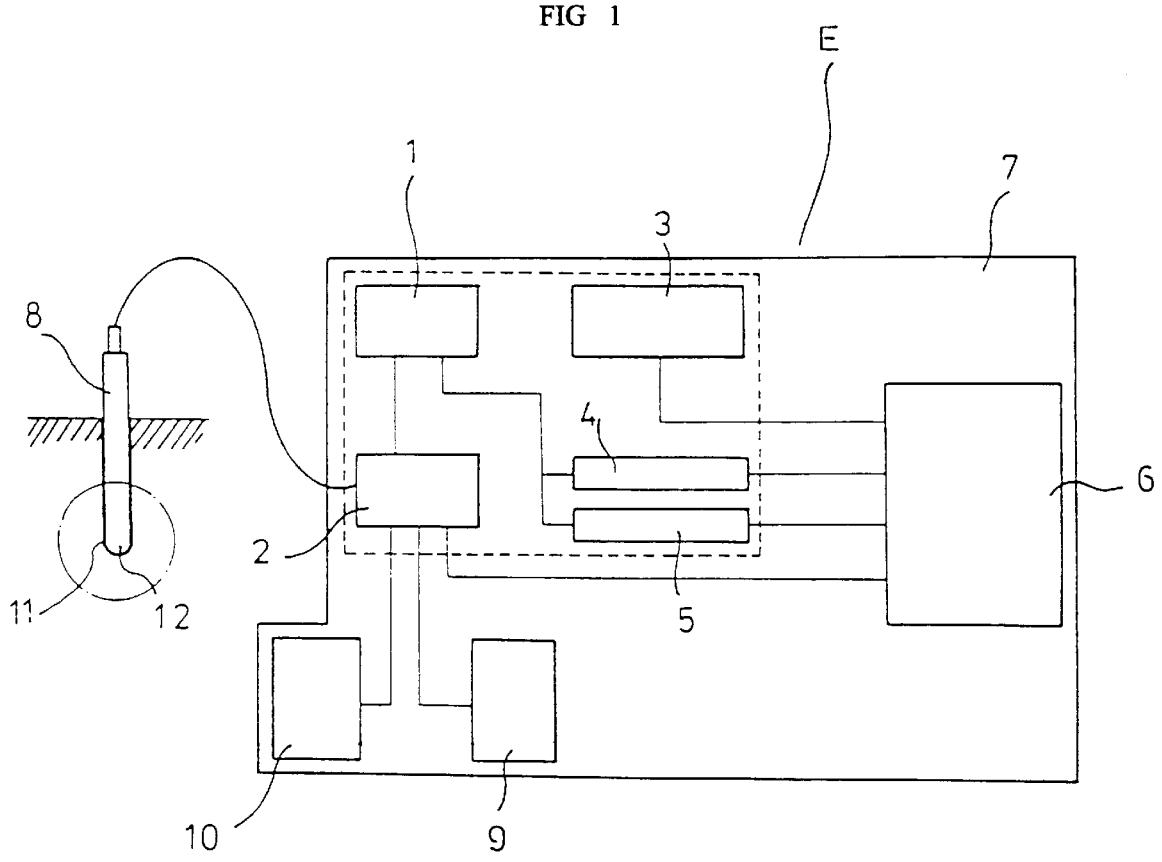
FIG. 1 is a block diagram illustrating the rock fragmentation system using Gold Schmidt method in accordance with an embodiment of the present invention.
Figure 2:
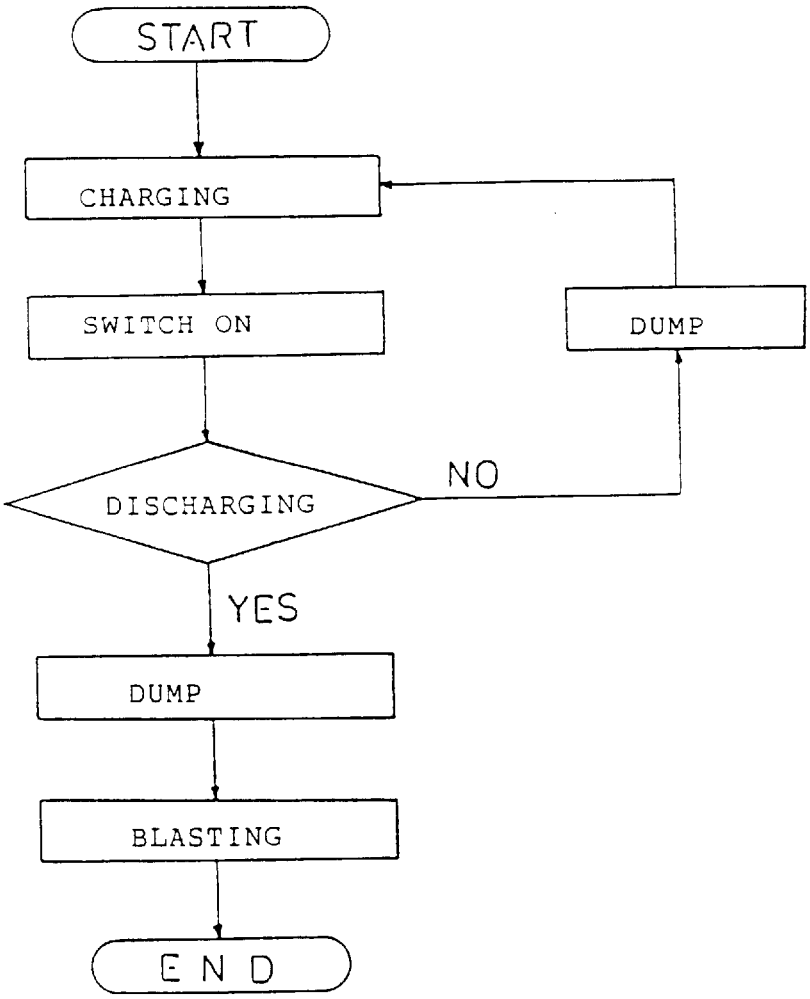
FIG. 2 is a flowchart illustrating the operation of a Gold Schmidt blasting machine in accordance with an embodiment of the present invention.

As shown in FIG. 1, a rock fragmentation system using Gold Schmidt method in accordance with one embodiment of the present invention comprises a capacitor bank 1 where a plurality of capacitors are connected for discharging high voltage, a switch 2 where high current is connected into an electrode assembly 8 when the high voltage is discharged from the capacitor bank 1, a high voltage electric power supply 3, where the high voltage is generated for charging the capacitor bank 1, a first charge dump 4 for discharging into a resistance, the electric charge remaining in the capacitor bank 1 when blasting is complete, a second charge dump 5 for discharging the electric charge stored in the capacitor bank portion 1 when blasting is unsuccessful after charging the capacitor bank 1, a control box 6 for controlling the operations of charging and blasting, and a composition 12 comprising a mixture of aluminum and a metallic oxide in a weight ratio sufficient to cause an explosion upon sudden high voltage electrical charging of the composition 12. This composition 12 is inserted between electrodes in a lower end of the electrode assembly 8 and receives electric energy from the capacitor bank and switch thereby generating nearly instantaneous reaction energy and increasing blasting force.

In the blasting machine of the present invention, the metal oxide (MO) used can be any metal oxide that provides reaction with aluminum upon application of high voltage electrical energy (2 kV to 10 kV, preferably 5 kV to 9 kV). Suitable metal oxides include Cu oxides, Mn oxides, Cr oxides, Zn oxides, Ni oxides, and Fe oxides, with CuO being most preferred. The Al and MO are used in a weight ratio sufficient to result in an explosion upon sudden application of high voltage electrical energy.

The application of the high voltage energy to the mixture of Al and MO must occur at a rate sufficient to cause sudden reaction energy production due to the interaction of the Al and MO. The sudden reaction energy produced must be sufficient in strength to cause blasting.

The operation of a rock fragmentation system using Gold Schmidt method in accordance with a preferred embodiment of the present invention will be described below.

First, a worker installs the electrode assembly 8, containing the composition 12, comprising the mixture of aluminum and a metal oxide, inserted between electrodes in a lower end thereof in the desired blasting point, connects a coaxial cable of the rock fragmentation system using Gold Schmidt method of the present invention with an electric power connector, and then switches a charging switch formed on control panel 7 to the ON position. The high voltage power supply 3 converts into high voltage (≧5 kV, preferably, ≧10 kV) and introduced into the capacitor bank portion 1 from. The control box 6 switches the connection between the high voltage power portion 3 and the capacitor bank portion 1, thereby charging the capacitor bank portion 1.

After completing the charging, when the worker switches a blasting switch formed on the control panel 7 to the ON position, the control box 6 operates the switch 2 introduces high current from the capacitor bank 1 into the electrode assembly 8 and discharges it into the aluminum and metal oxide composition 12 inserted between electrodes 11 and 11' in a lower end of the electrode assembly 8, to generate an explosion.

Further, the control box 6 switches the blasting switch and the connection between the capacitor bank 1 and the first charge dump 4 at the same time, thereby discharging any remaining charge in the capacity bank 1. The discharge of the remaining energy by the first charge dump 4 is preferably performed using heat resistance.

The rock fragmentation system using Gold Schmidt method of the present invention instantly discharges high voltage electric energy into the aluminum and metal oxide composition inserted between electrodes in a lower end of the electrode assembly so that instant reaction energy is generated thereby blasting a rock of solid material. But the present invention does not generate a large quantity or dust, noise, gas, or vibration, thereby preventing environmental pollution and improving safety. When water ($H_2O$) is added (up to about 10% by weight based on the amount of the mixture of aluminum and metal oxide) to the aluminum and metallic oxide composition, the blasting force can be further increased, thereby obtaining an adjustable blasting force and constructiveness.

What is claimed as new and desired to be secured by Letters Patent of the United States is:

1. A rock fragmentation system employing a thermite reaction of aluminum and a metal oxide, wherein said system comprises:

a capacitor bank connected to a switch;

a first and second charge dump connected to said capacitor bank;

a high voltage electric power supply for generating a high voltage to charge said capacitor bank;

an electrode assembly connected to said switch whereby high current is fed to said electrode assembly when said high voltage is discharged from said capacitor bank and wherein said electrode assembly includes at least two electrodes at a lower end of said assembly wherein said at least two electrodes have positioned between said at least two electrodes a composition comprising a mixture of aluminum (Al) and CuO in a ratio of Al; CuO sufficient to provide a blasting force upon rapid introduction of electrical energy of the Al/CuO mixture.

2. The rock fragmentation system using Gold Schmidt method as claimed in claim 1, wherein said mixture of aluminum and a CuO further comprises water.

3. A process for blasting comprising:

storing high voltage electrical energy in a capacitor bank comprising a plurality of capacitors;

introducing said high voltage electrical energy from said capacitor bank into an electrode assembly comprising at least two electrodes at a lower end of the electrode assembly and a composition comprising a mixture of aluminum (Al) and a CuO, in a ratio of Al:CuO sufficient to provide a blasting force upon rapid introduction of electrical energy of the Al/CuO mixture, wherein the composition is inserted between said at least two electrodes.

4. The process for blasting as claimed in claim 3, further comprising discharging excess energy stored in said capacitor bank after said introduction step into a charge dump connected to said capacitor bank, wherein said excess energy is dissipated by heat resistance.

5. The process for blasting as claimed in claim 3, wherein said mixture of aluminum and a metal oxide further comprises water.

* * * * *